US006557850B1

(12) United States Patent
Kallin et al.

(10) Patent No.: US 6,557,850 B1
(45) Date of Patent: May 6, 2003

(54) RETRACTABLE TRACK GUIDE APPARATUS FOR USE IN A DOCUMENT PROCESSING SYSTEM

(75) Inventors: Fredrik L. N. Kallin, Waterloo (CA); Svetozar Doroslovac, Waterloo (CA)

(73) Assignee: NCR Corporation, Dayton, OH (US)

( * ) Notice: Subject to any disclaimer, the term of this patent is extended or adjusted under 35 U.S.C. 154(b) by 0 days.

(21) Appl. No.: 09/992,364

(22) Filed: Nov. 16, 2001

(51) Int. Cl.[7] ..... B65H 5/06

(52) U.S. Cl. ..... 271/274; 271/264; 271/273; 271/306; 271/272

(58) Field of Search ..... 271/264, 306, 271/273, 272, 274, 314

(56) References Cited

U.S. PATENT DOCUMENTS 3,982,752 A * 9/1976 Langford ..... 271/248
4,431,179 A * 2/1984 Westover et al. ..... 271/274
5,499,809 A * 3/1996 Takemoto et al. ..... 271/274

* cited by examiner

*Primary Examiner*—Donald P. Walsh
*Assistant Examiner*—Kaitlin Joerger
(74) *Attorney, Agent, or Firm*—Michael Chan

(57) ABSTRACT

A check processing module includes a hardware device disposed along a document track for processing document items moving from an upstream end of the document track to a downstream end of the document track. A number of outer panels covers the hardware device during operation of the check processing module. At least one idler roller is provided for engaging a document item in the document track when the idler roller is in a non-retracted position. When a button is operated by an operator, the idler roller moves from a non-retracted position to a retracted position away from a document item in the document track to allow the operator to more easily gain access to the document track without having to remove any of the outer panels covering the hardware device positioned along the document track.

12 Claims, 8 Drawing Sheets

RETRACTABLE TRACK GUIDE APPARATUS FOR USE IN A DOCUMENT PROCESSING SYSTEM

The related application entitled "Retractable Track Idler Apparatus For Use In A Document Processing System" is filed on even date herewith.

BACKGROUND OF THE INVENTION

The present invention relates to document processing systems, and is particularly directed to a retractable track guide apparatus for use in a document processing system, such as an image-based check processing system.

A typical image-based check processing system includes a check processing transport which has a document track and a number of check processing modules positioned along the document track for performing specific document processing operations on document items including checks moving downstream along the document track. Each check processing module includes a number of outer panels which cover a number of hardware devices contained within the check processing module during operation of the check processing transport. The check processing system also includes a transport processor which executes a transport application program which is stored in memory to control operation of the hardware devices contained within the check processing modules positioned along the document track and thereby to control operation of the check processing transport.

More specifically, the check processing transport includes a hopper module into which a stack of document items are placed. A document feeder module adjacent the hopper module selectively feeds or drives each document item from the stack of document items in the hopper module to transport the document item from the upstream end to the downstream end along the document track to sorting pockets of a pocket module located at the end of the document track. The pockets receive document items which have been sorted in accordance with the transport application program.

From time to time, a document item jam may occur while processing document items on the check processing transport. Typically, when a document item jam occurs, an operator manually locates any document items in the document track that have not been completely processed and removes these document items from the document track. To avoid problems further downstream, the operator must ensure that all document items which have not been completely processed are removed from the document track. Once the problem that caused the document item jam is resolved, the operator must reprocess the document items in their original order.

When a jammed document item is removed from the document track, it is desirable to be able to easily remove the document item and to not tear the document item while the document item is being removed from the document track. In known check processing modules, at least one outer panel covering the hardware devices contained within that check processing module needs to be opened and/or removed before a jammed document item can be removed from the document track. After the at least one outer panel is opened and/or removed, a number of idler rollers associated with the check processing module usually needs to be moved away from the jammed document item to release the document item before the document item can be removed from the document track.

SUMMARY OF THE INVENTION

In accordance with one aspect of the present invention, a retractable track guide apparatus comprises at least one idler roller for engaging a document item in a document track when the idler roller is in a non-retracted position. First manually-operable means is provided for (i) when operated after a document item jam condition occurs along the document track, moving the idler roller from the non-retracted position to a retracted position away from a document item jammed in the document track to allow the jammed document item to be more easily removed from the document track, and (ii) when released after the jammed document item has been removed from the document track, allowing the idler roller to be moved from the retracted position back to the non-retracted position. The first manually-operable means may include a button accessible to the operator from above the document track. The retractable track guide apparatus may further comprise second manually-operable means for, when operated by an operator, moving the idler roller from the retracted position back to the non-retracted position. The second manually-operable means may include a guide flange accessible to the operator from above the document track.

In accordance with yet another aspect of the present invention, a retractable track guide apparatus is provided for use in a document processing system having a document track, a number of hardware devices positioned along the document track, and a number of outer panels covering the hardware devices. The retractable track guide apparatus comprises at least one idler roller for engaging a document item in the document track when the idler roller is in a non-retracted position. First manually-operable means is provided for, when operated by an operator, moving the idler roller from the non-retracted position to a retracted position away from a document item in the document track to allow the operator to more easily gain access to the document track without having to remove any of the outer panels covering the hardware devices positioned along the document track. The manually-operable means may include a button accessible to the operator from above the document track. The retractable track guide apparatus may further comprise second manually-operable means for, when operated by an operator, moving the idler roller from the retracted position back to the non-retracted position without having to remove any of the outer panels covering the hardware devices positioned along the document track. The second manually-operable means may include a guide flange accessible to the operator from above the document track.

In accordance with yet another aspect of the present invention, a check processing module comprises means defining at least a portion of a document track along which document items can move from an upstream end to a downstream end. A hardware device disposed along the document track is provided for processing document items moving from the upstream end of the document track to the downstream end of the document track. A number of outer panels covers the hardware device during operation of the check processing module. At least one idler roller is provided for engaging a document item in the document track when the idler roller is in a non-retracted position. First manually-operable means is provided for, when operated by an operator, moving the idler roller from the non-retracted position to a retracted position away from a document item in the document track to allow the operator to more easily gain access to the document track without having to remove any of the outer panels covering the hardware device positioned along the document track. The retractable track guide apparatus may further comprise second manually-operable means for, when operated by an operator, moving the idler roller from the retracted position back to the non-retracted position without having to remove any of the outer panels.

In accordance with another aspect of the present invention, a check processing system comprises means defining at least a portion of a document track along which document items can move from an upstream end to a downstream end. A hardware device disposed along the document track is provided for processing document items moving from the upstream end of the document track to the downstream end of the document track. At least one idler roller is provided for engaging a document item in the document track when the idler roller is in a non-retracted position. First manually-operable means is provided for (i) when operated after a document item jam condition occurs along the document track, moving the idler roller from the non-retracted position to a retracted position away from a document item jammed in the document track to allow the jammed document item to be more easily removed from the document track, and (ii) when released after the jammed document item has been removed from the document track, allowing the idler roller to be moved from the retracted position back to the non-retracted position. The check processing system may further comprise second manually-operable means for, when operated by an operator, moving the idler roller from the retracted position back to the non-retracted position.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DETAILS OF THE INVENTION

Figure 1:
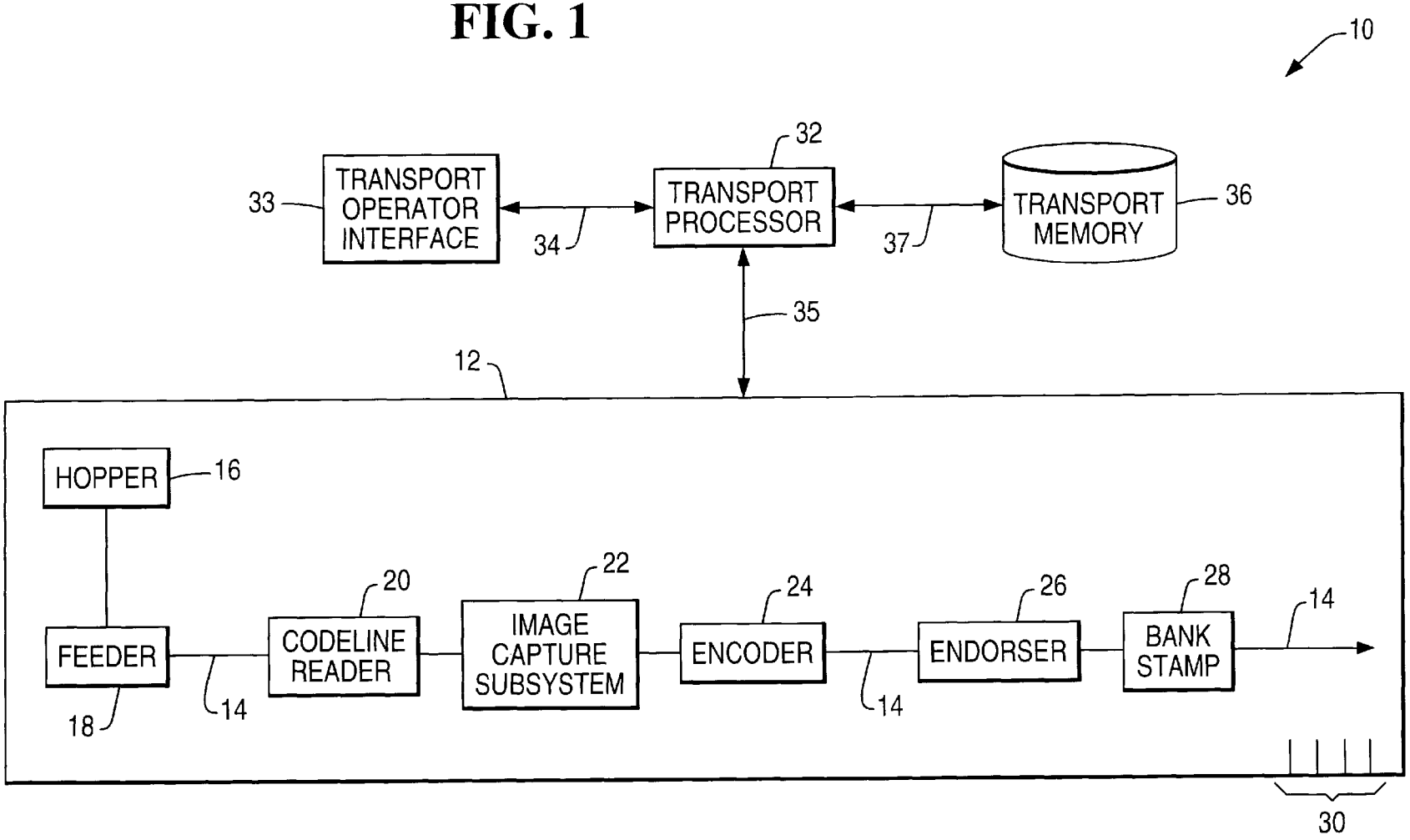
FIG. 1 is a schematic block representation of an image-based check processing system embodying the present invention.

The present invention is directed to a retractable track guide apparatus for use in a document processing system. The specific construction and use of the document processing system may vary. By way of example, a document processing system in the form of an image-based check processing system 10 is illustrated in FIG. 1. The check processing system 10 may be, for example, a sorting machine or a proof machine wherein financial document items such as checks are processed in a bank.

As shown in FIG. 1, the check processing system 10 includes a check processing transport 12 having a document track 14 along which financial document items, such as checks, can be transported from an upstream end to a downstream end. The transport 12 includes a number of different check processing modules lying along the document track 14. Each check processing module includes a number of hardware devices associated with the particular check processing module for performing specific document processing operations on document items moving along the document track. The transport 12 includes a hopper module 16 into which a stack of financial document items including checks are placed. A document feeder module 18 adjacent the hopper 16 selectively feeds or drives each document item from the stack of document items in the hopper to transport the document item from the upstream end to the downstream end along the document track 14 to sorting pockets of a pocket module 30 located at the end of the document track.

The check processing system 10 includes a codeline reader module 20 such as a MICR reader located along the document track 14. The MICR reader 20 reads a MICR codeline from each check being processed in a known manner. Alternatively, the codeline reader may be an OCR reader instead of a MICR reader depending upon the particular application. The check processing system 10 further includes an image capture subsystem module 22 located along the document track 14. The image capture subsystem 22 captures an image of each document item for a number of different purposes well known in the financial industry. More specifically, the image capture subsystem 22 includes an imaging camera (not shown) which is controlled to capture images of document items moving along the document track 14. An encoder module 24 encodes missing fields on each check. An endorser module 26 applies an endorsement in a known manner to each check. A bank stamp module 28 stamps each check to identify the bank institution processing the check. The structure and operation of MICR readers, OCR readers, imaging cameras, encoders, endorsers, and bank stamps are well known and, therefore, will not be described.

The check processing system 10 further includes a transport processor 32 and a transport operator interface 33 which communicates via signals on line 34 with the transport processor. The operator interface 33 may include a keyboard, a mouse, and a display, all of which communicate via signals with the transport processor 32. The transport processor 32 controls operation of the transport 12 via signals on line 35. Suitable processors and memories are readily available in the marketplace. Their structure and operation are well known and, therefore, will not be described.

The check processing system 10 also includes a transport memory 36 which communicates via signals on line 37 with the transport processor 32. It is contemplated that the memory 36 could be a single memory unit or a plurality of different memory units. An executable transport application program is stored in the memory 36. The transport application program is associated with a particular type of document processing work. For example, one type of work is proof of deposit. Another type of work is remittance processing. Still another type of work may be sorting of document items. When the transport application program is executed, the hardware devices contained within the check processing modules lying along the document track 14 are controlled to process document items moving downstream along the document track in accordance with the transport application program, as is known. The memory 36 also stores sequence numbers, MICR codelines, image data, encoder status, endorsement status, and bank stamp status associated with document items which have been processed in accordance with the transport application program.

Figure 2:
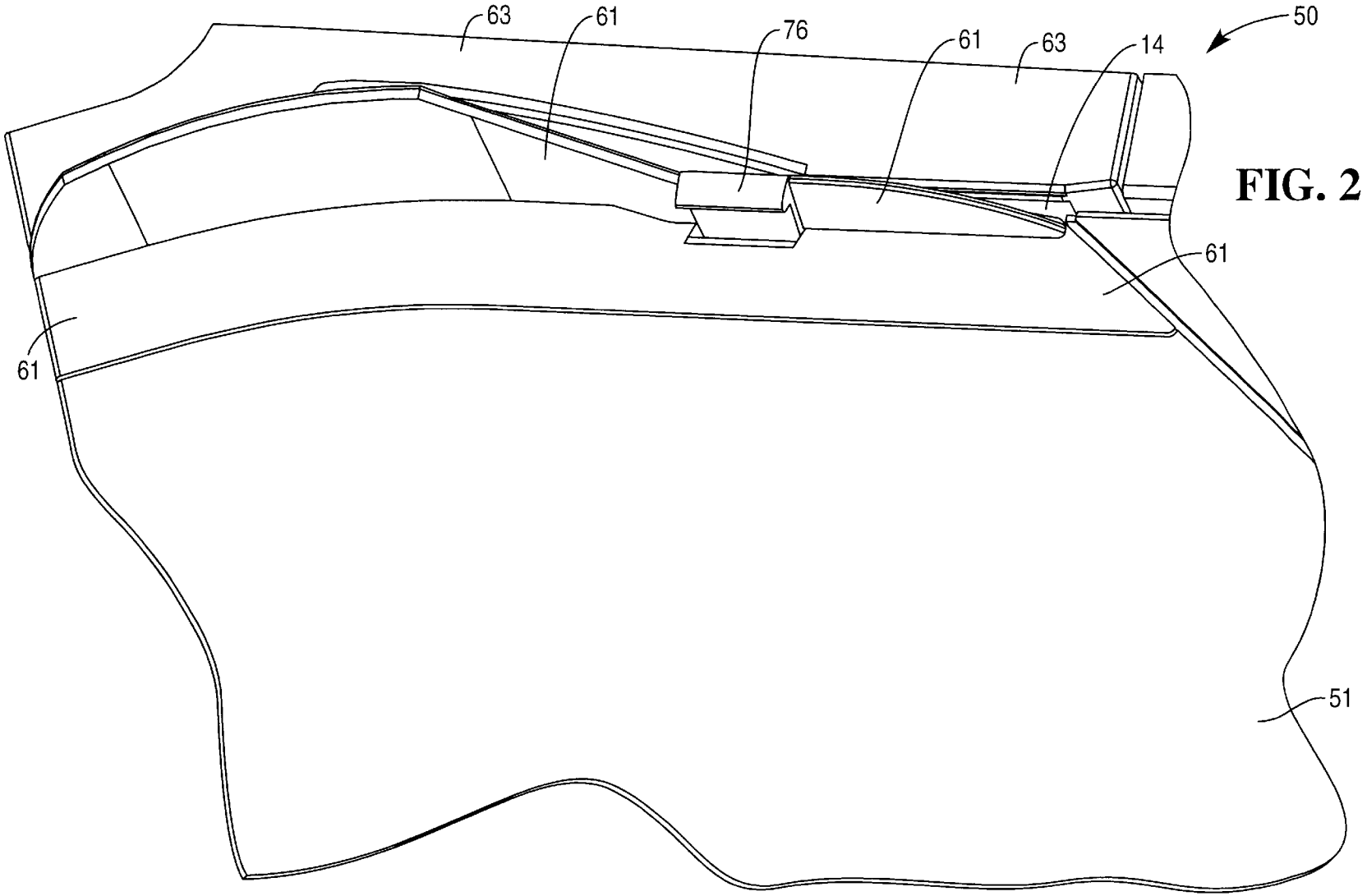
FIG. 2 is a top perspective view of a retractable track guide apparatus used in the image-based check processing system of FIG. 1 and shown in a non-retracted position.
Figure 3:
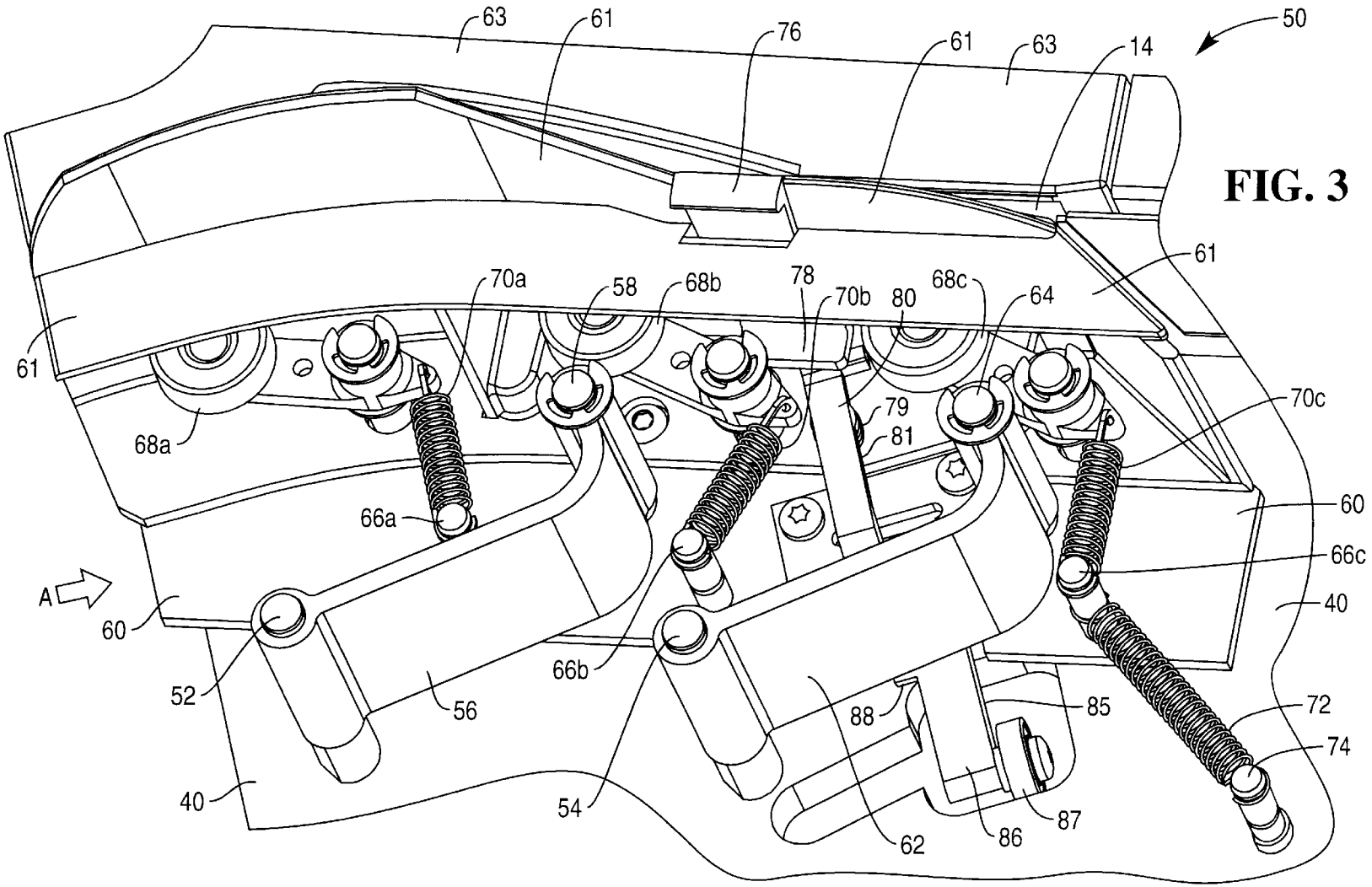
FIG. 3 is a perspective view similar to FIG. 2 and showing a number of outer panels removed.
Figure 4:
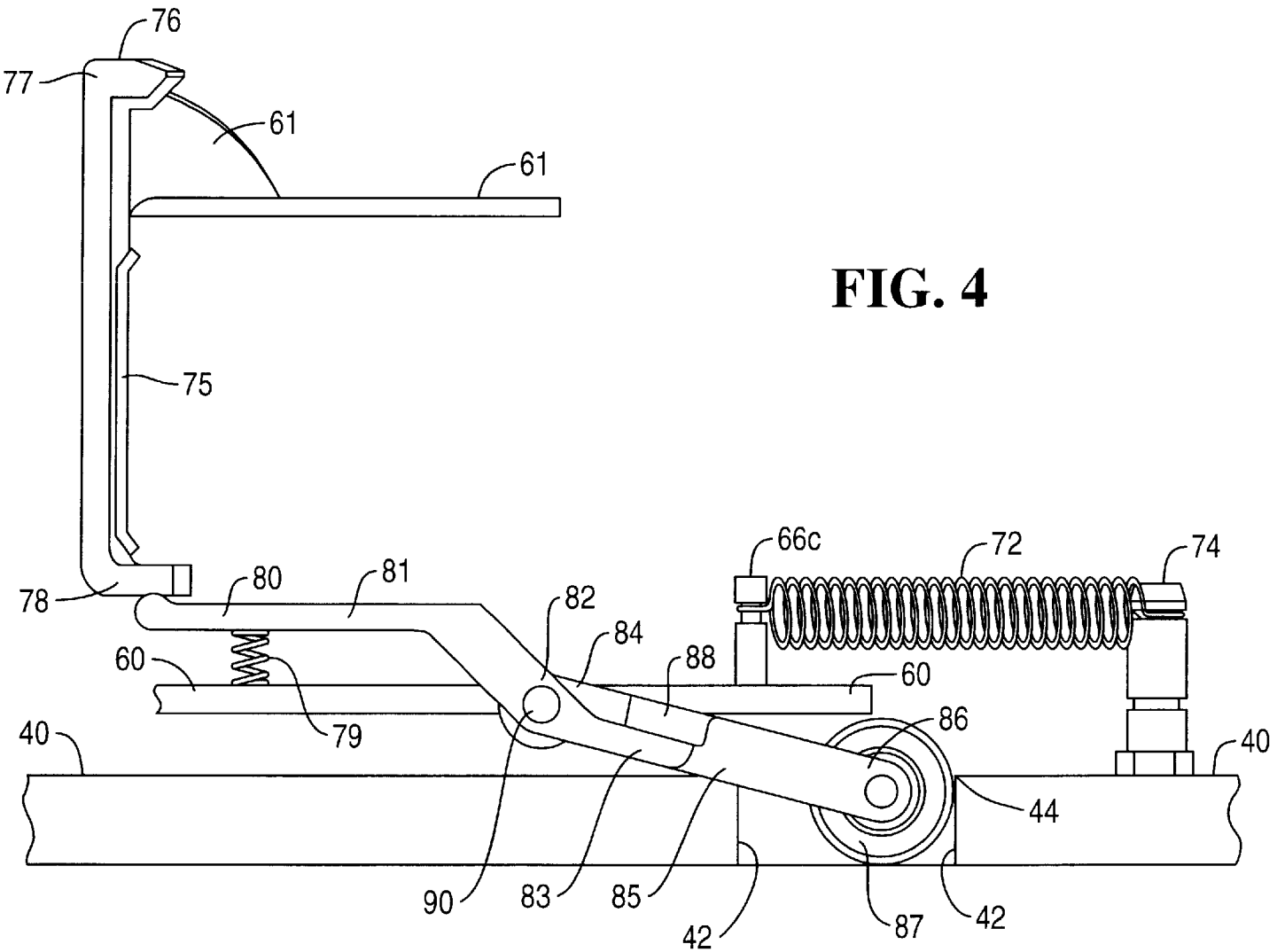
FIG. 4 is an elevational view looking approximately in the direction of arrow A in FIG. 3.

Referring to FIG. 2, a retractable track guide apparatus 50 in accordance with the present invention is illustrated. The apparatus 50 is embodied in a typical check processing module and is shown in FIG. 2 in a non-retracted position. A number of outer panels 51 associated with the particular check processing module covers parts of the apparatus 50. FIG. 3 is a perspective view similar to FIG. 2 and showing outer panels 51 removed. FIG. 4 is an elevational view looking approximately in the direction of arrow "A" in FIG. 3. Parts of the apparatus 50 are in the non-retracted position shown in FIGS. 2–4 during normal operation of the particular check processing module in which the apparatus is installed.

A typical check processing module usually has a baseplate to which components making up the hardware device(s) associated with the check processing module are attached. For purposes of describing the present invention, a baseplate of the particular check processing module in which the apparatus 50 is installed is designated in FIGS. 3 and 4 with the reference numeral "40".

Referring to FIGS. 3 and 4, the retractable track guide apparatus 50 includes a first pivot shaft 52 which is fixedly mounted on the baseplate 40, and a second pivot shaft 54 which is also fixedly connected to the baseplate 40. The retractable track guide apparatus 50 further includes a first pivot arm 56 having one end thereof pivotably connected to the first pivot shaft 52 and the opposite end thereof pivotably connected to a third pivot shaft 58 which is fixedly connected to a pivot plate 60. Similarly, a second pivot arm 62 has one end thereof pivotably connected to the second pivot shaft 54 and the opposite end thereof pivotably connected to a fourth pivot shaft 64 which is fixedly connected to the pivot plate 60. The pivot plate 60 is fixedly connected to a movable guide flange 61 which lies opposite a fixed guide flange 63. The guide flanges 61, 63 define therebetween at least a portion of the document track 14.

Three relatively short pivot shafts 66*a*, 66*b*, 66*c* are fixedly connected to the pivot plate 60. Three idler rollers 68*a*, 68*b*, 68*c* are operatively connected through three springs 70*a*, 70*b*, 70*c*, respectively, to the short pivot shafts 66*a*, 66*b*, 66*c*, respectively. The three idler rollers 68*a*, 68*b*, 68*c* are operatively connected to the respective three short pivot shafts 66*a*, 66*b*, 66*c* in a known manner and, therefore, will not be described further. An extension spring 72 is connected between the short pivot shaft 66*c* and another short pivot shaft 74 which is fixedly connected to the baseplate 40.

The retractable track guide apparatus 50 further includes a pushable button 76 in a form like that of a push rod, as best shown in FIG. 4. A holding bracket 75 supports the button 76 for up and down sliding movement (as viewed looking at FIG. 4). One end 77 of the button 76 is located in the vicinity of the guide flange 61 and sufficiently exposed and accessible to allow an operator to push down on that end of the button. The other end 78 of the button 76 is located adjacent one end 80 of a lever arm 81. A spring 79 is compressed between pivot plate 60 and the one end 80 of the lever arm 81. A central portion 82 of the lever arm 81 is pivotably connected to part of a pivot pin 90. The other end 83 of the lever arm 81 abuts against a centrally projecting portion 88 of a bearing arm 85. One end 84 of the bearing arm 85 is pivotably connected to another part of the pivot pin 90. The other end 86 of the bearing arm 85 is rotatably connected to a bearing roller 87 which is disposed in a slot 42 of the baseplate 40.

When a document item in a portion of the document track 14 associated with the particular check processing module in which the apparatus 50 is installed needs to be removed from the document track 14, an operator initially pushes down on the button 76 (as viewed looking at FIG. 4). When the operator pushes down on the button 76, the parts of the apparatus 50 move from the position shown FIGS. 3 and 4 to the position shown in FIGS. 5 and 6, respectively. More specifically, the end 78 of the button 76 moves against the end 80 of the lever arm 81 to pivot the lever arm 81 about the pivot pin 90 counterclockwise (as viewed looking at FIG. 4) such that the end 80 moves in an arc downwards to compress the spring 79 and the other end 83 moves in an arc upwards to pivot the bearing arm 85 about the pivot pin 90 in the counterclockwise direction. When the bearing arm 85 pivots about the pivot pin 90 in the counterclockwise direction, the bearing roller 87 moves in an arc out of the slot 42 in the baseplate 40.

Figure 5:
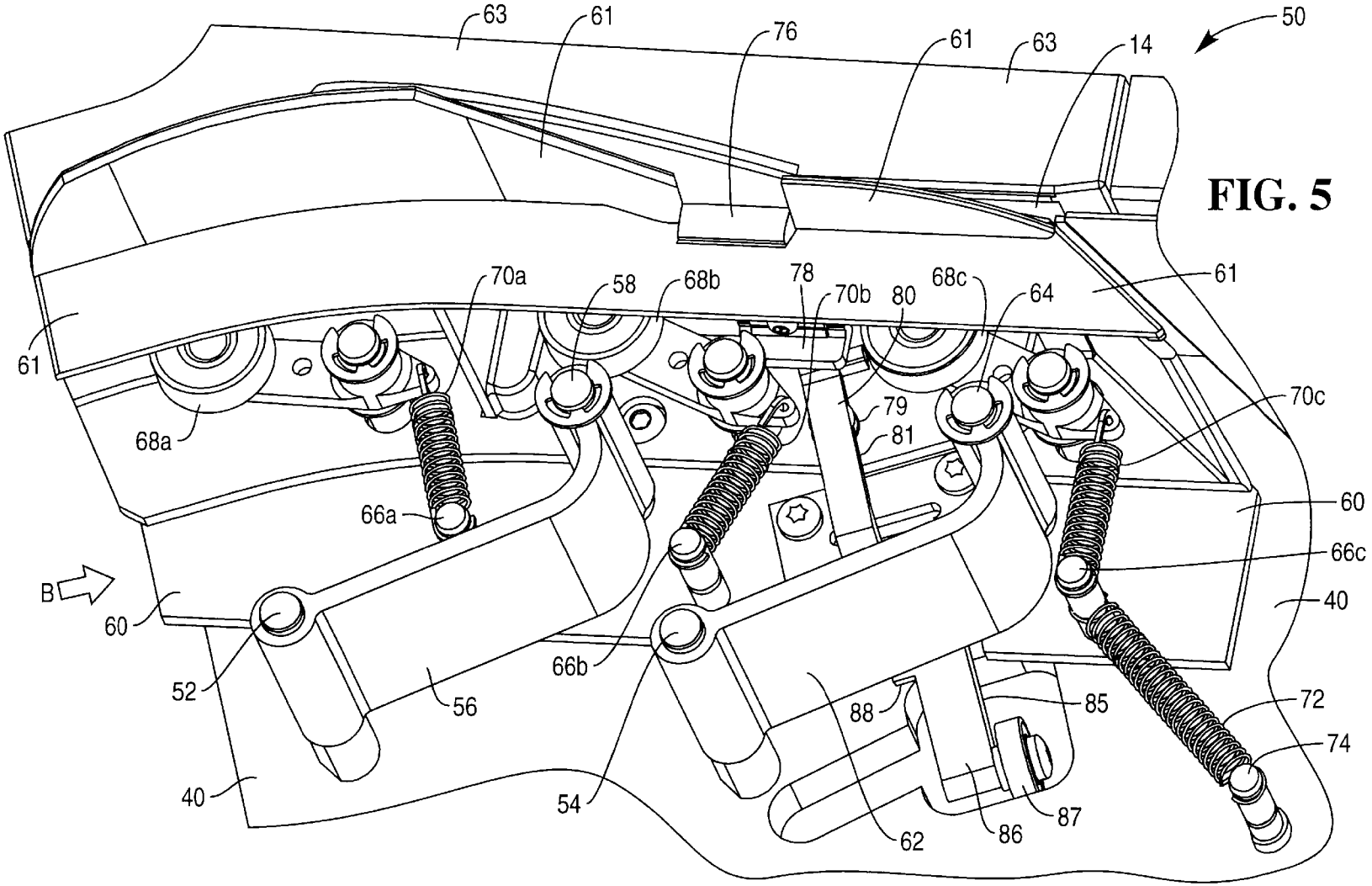
FIG. 5 is a top perspective view similar to FIG. 3 and showing parts in a different position.
Figure 6:
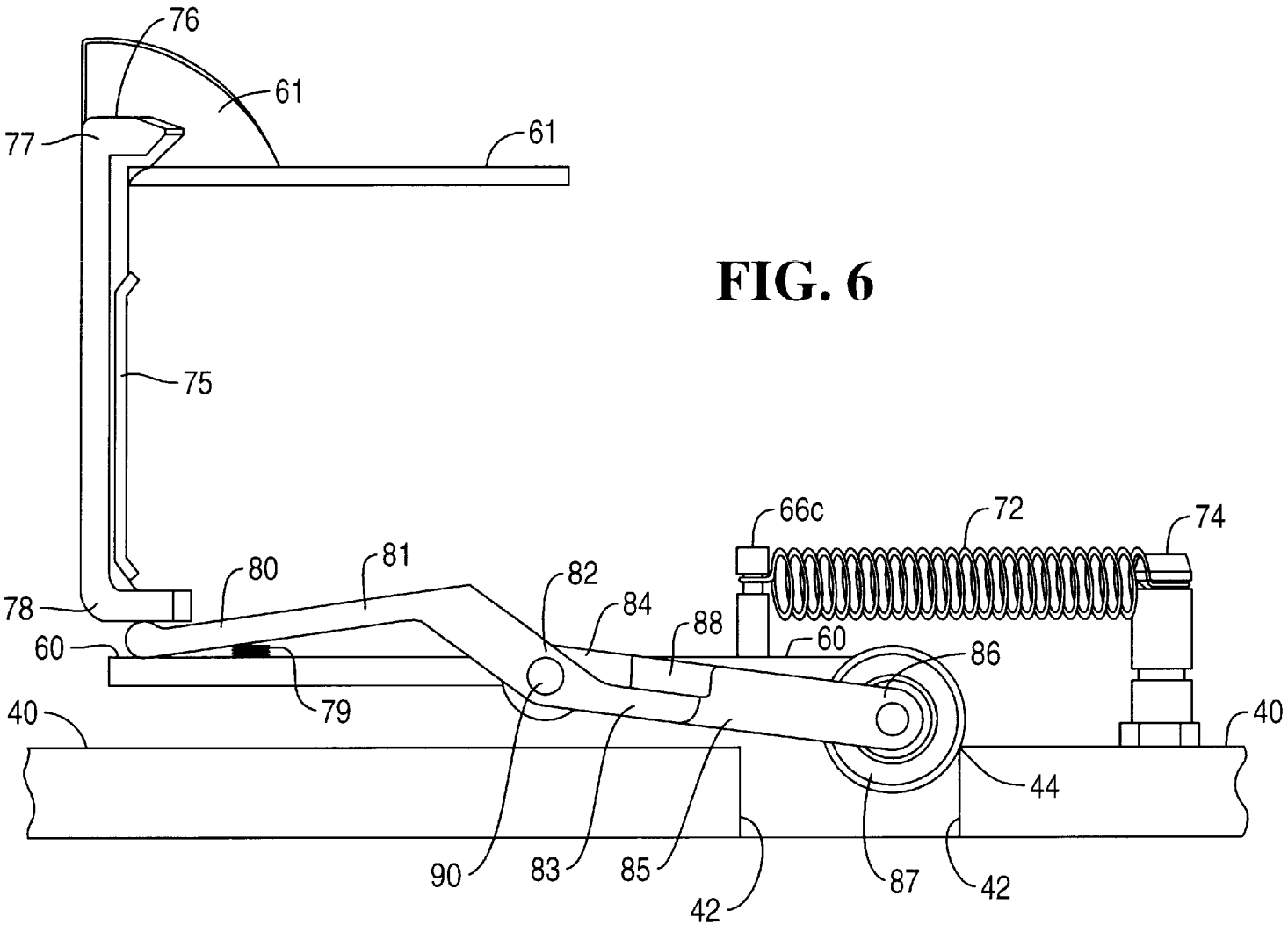
FIG. 6 is an elevational view looking approximately in the direction of arrow B in FIG. 5.

After the operator pushes down on the button 76 and the parts of the apparatus 50 move from the position shown in FIGS. 3 and 4 to the position shown in FIGS. 5 and 6, respectively, the tension in the spring 72 is sufficient to move the bearing roller 87 to the right (as viewed looking at FIG. 6) over a corner edge 44 of the baseplate 40. When the bearing roller 87 moves over the corner edge 44 of the baseplate 40, the tension in the spring 72 continues to move the pivot plate 60 and parts connected thereto to the right (as viewed looking at FIG. 6) until the parts have moved to a retracted position shown in FIGS. 7 and 8.

Figure 7:
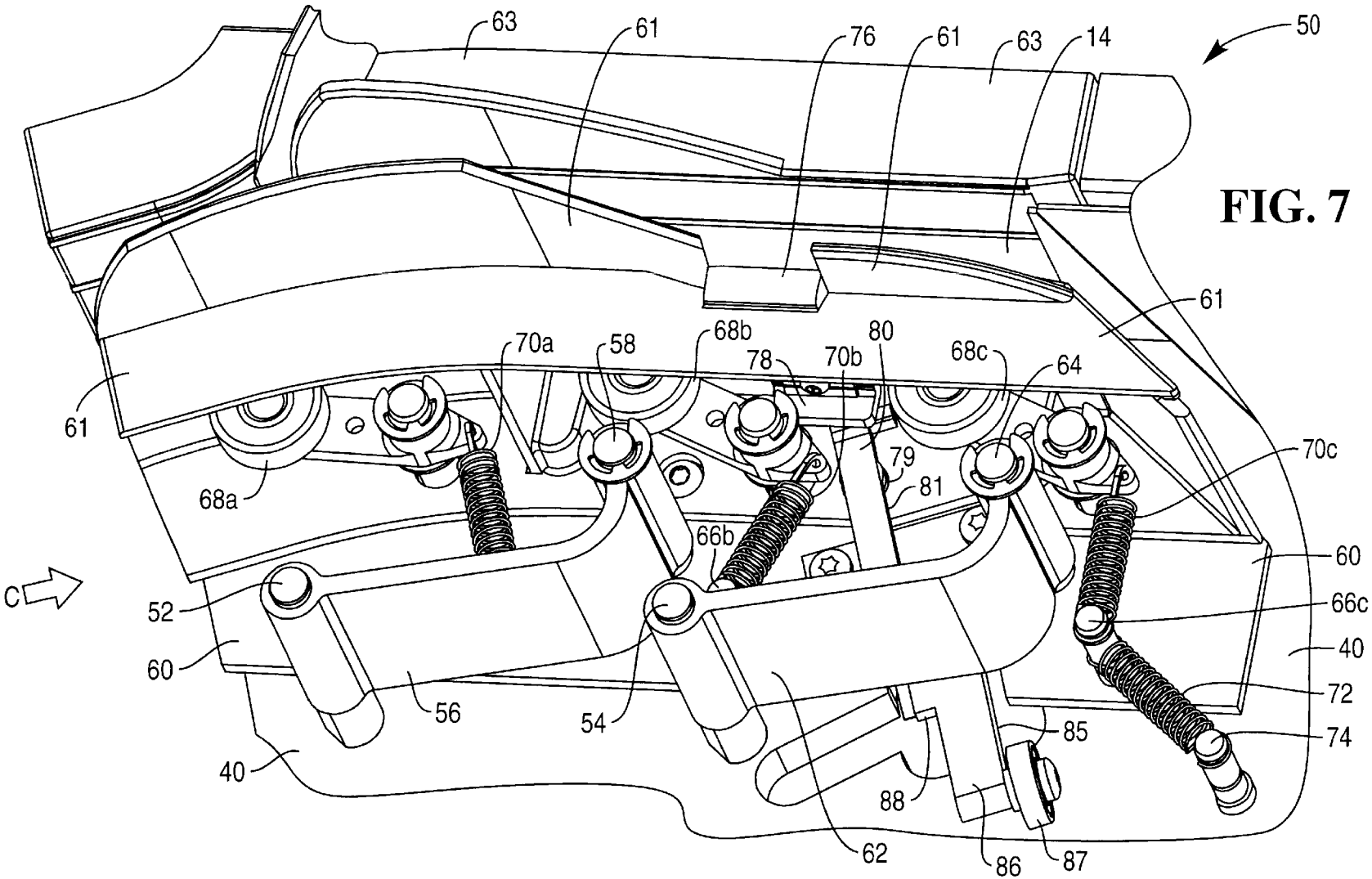
FIG. 7 is a top perspective view similar to FIG. 3 and showing the retractable track guide apparatus in a retracted position.
Figure 8:
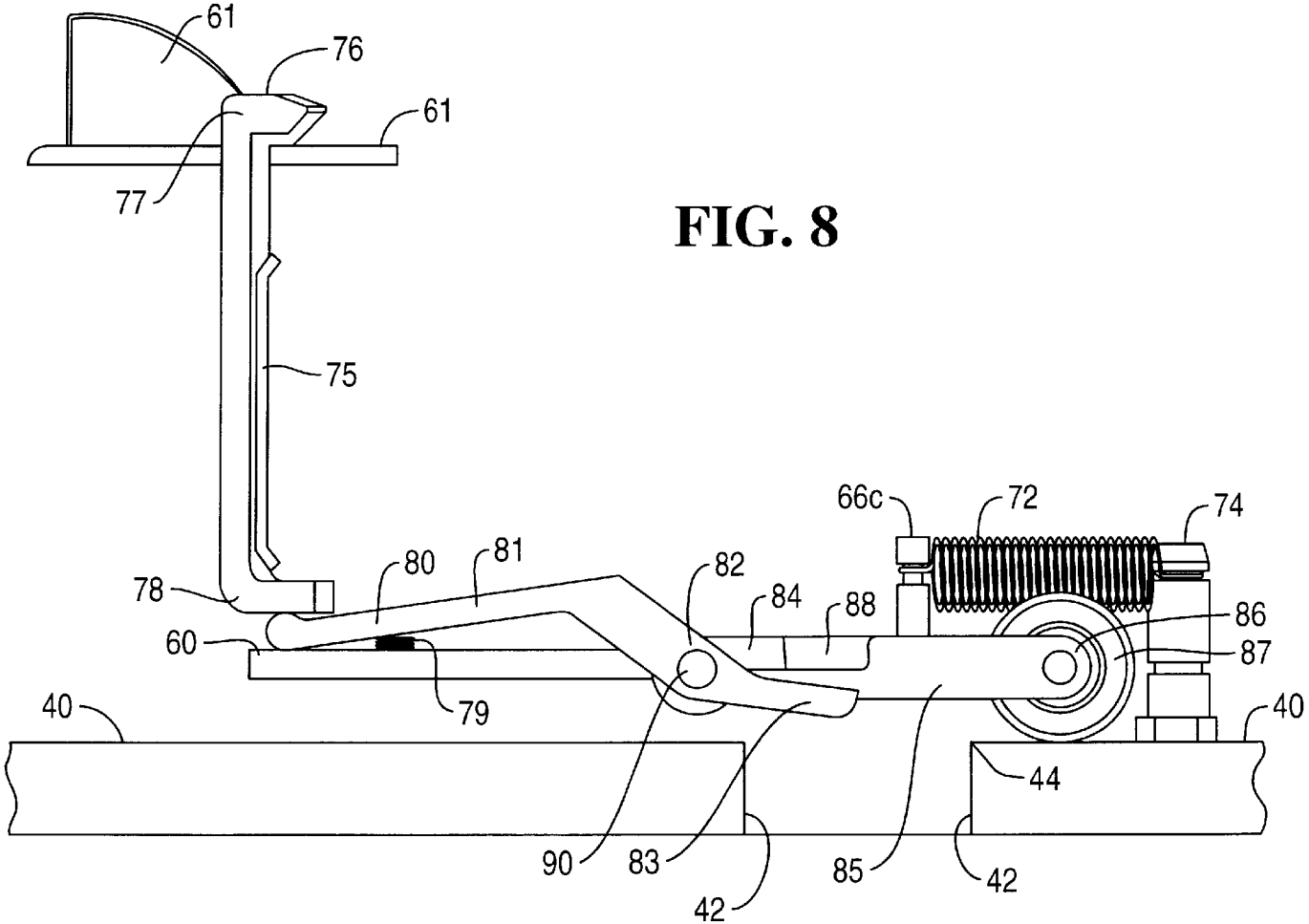
FIG. 8 is an elevational view looking approximately in the direction of arrow C in FIG. 7.

As parts of the apparatus 50 move from the position shown in FIGS. 5 and 6 to the position shown in FIGS. 7 and 8, a wider gap is formed between the guide flange 61 and the opposite guide flange 63. This wider gap allows the operator to more easily access the document track 14 to clean the document track or to remove a document jammed in the document track, for examples. After the document track 14 has been cleaned or cleared of a jammed document, the operator can then push the guide flange 61 into the page and to the left (as viewed in FIGS. 7 and 8, respectively) to move parts of the apparatus 50 from the retracted position shown in FIGS. 7 and 8 back to the non-retracted position shown in FIGS. 3 and 4.

A number of advantages result from providing the retractable track guide apparatus 50 in accordance with the present invention. One advantage is that parts of the track guide apparatus 50 can be moved from the non-retracted position shown in FIGS. 3 and 4 to the retracted position shown in FIGS. 7 and 8 without having to open and/or remove any cabinetry parts, such as the outer panels 51 shown in FIG. 2, to gain access to the document track 14. This allows an operator to more easily remove a jammed document from the document track 14, and/or to more easily remove debris and clean the document track, for examples.

From the above description of the invention, those skilled in the art to which the present invention relates will perceive improvements, changes and modifications. Numerous substitutions and modifications can be undertaken without departing from the true spirit and scope of the invention. Such improvements, changes and modifications within the skill of the art to which the present invention relates are intended to be covered by the appended claims.

What is claimed is:

1. A retractable track guide apparatus comprising:

at least one idler roller for engaging a document item in a document track when the idler roller is in a non-retracted position; and first manually-operable means for, when operated a first time and then released by an operator after a document item jam condition occurs along the document track, moving the idler roller from the non-retracted position to a retracted position away from a document item jammed in the document track to allow the jammed document item to be more easily removed from the document track.

2. A retractable track guide apparatus according to claim 1, wherein the first manually-operable means includes a button accessible to the operator from above the document track.

3. A retractable track guide apparatus according to claim 1, further comprising second manually-operable means for, when operated a second time which is after the first time by an operator, moving the idler roller from the retracted position back to the non-retracted position.

4. A retractable track guide apparatus according to claim 3, wherein the second manually-operable means includes a guide flange accessible to the operator from above the document track.

5. A retractable track guide apparatus for use in a document processing system having a document track, a number of hardware devices positioned along the document track, and a number of outer panels covering the hardware devices, the retractable track guide apparatus comprising:

at least one idler roller for engaging a document item in the document track when the idler roller is in a non-retracted position; and first manually-operable means for, when operated a first time and then released by an operator, moving the idler roller from the non-retracted position to a retracted position away from a document item in the document track to allow the operator to more easily gain access to the document track without having to remove any of the outer panels covering the hardware devices positioned along the document track.

6. A retractable track guide apparatus according to claim 5, wherein the manually-operable means includes a button accessible to the operator from above the document track.

7. A retractable track guide apparatus according to claim 5, further comprising second manually-operable means for, when operated a second time which is after the first time by an operator, moving the idler roller from the retracted position back to the non-retracted position without having to remove any of the outer panels covering the hardware devices positioned along the document track.

8. A retractable track guide apparatus according to claim 7, wherein the second manually-operable means includes a guide flange accessible to the operator from above the document track.

9. A check processing module comprising:

means defining at least a portion of a document track along which document items can move from an upstream end to a downstream end;

a hardware device disposed along the document track for processing document items moving from the upstream end of the document track to the downstream end of the document track;

a number of outer panels covering the hardware device during operation of the check processing module;

at least one idler roller for engaging a document item in the document track when the idler roller is in a non-retracted position; and first manually-operable means for, when operated a first time and then released by an operator, moving the idler roller from the non-retracted position to a retracted position away from a document item in the document track to allow the operator to more easily gain access to the document track without having to remove any of the outer panels covering the hardware device positioned along the document track.

10. A check processing module according to claim 9, further comprising second manually-operable means for, when operated a second time which is after the first time by an operator, moving the idler roller from the retracted position back to the non-retracted position without having to remove any of the outer panels.

11. A check processing system comprising:

means defining at least a portion of a document track along which document items can move from an upstream end to a downstream end;

a hardware device disposed along the document track for processing document items moving from the upstream end of the document track to the downstream end of the document track;

at least one idler roller for engaging a document item in the document track when the idler roller is in a non-retracted position; and first manually-operable means for, when operated a first time and then released by an operator after a document item jam condition occurs along the document track, moving the idler roller from the non-retracted position to a retracted position away from a document item jammed in the document track to allow the jammed document item to be more easily removed from the document track.

12. A check processing system according to claim 11, further comprising second manually-operable means for, when operated a second time which is after the first time by an operator, moving the idler roller from the retracted position back to the non-retracted position.

* * * * *